US009513054B2

(12) United States Patent
Wingate, Jr. et al.

(10) Patent No.: US 9,513,054 B2
(45) Date of Patent: Dec. 6, 2016

(54) FAN FOR DRYING OF LUMBER

(71) Applicant: BAXLEY EQUIPMENT CO., Hot Springs, AK (US)

(72) Inventors: Charles Reginal Wingate, Jr., Florence, SC (US); James Lloyd Anderson, Florence, SC (US)

(73) Assignee: BAXLEY EQUIPMENT CO, Hot Springs, AR (US)

( * ) Notice: Subject to any disclaimer, the term of this patent is extended or adjusted under 35 U.S.C. 154(b) by 263 days.

(21) Appl. No.: 14/334,786

(22) Filed: Jul. 18, 2014

(65) Prior Publication Data

US 2016/0018160 A1 Jan. 21, 2016

(51) Int. Cl.

| | |
|---|---|
| ***F26B 9/00*** | (2006.01) |
| ***F04D 13/06*** | (2006.01) |
| ***F04D 19/00*** | (2006.01) |
| ***F04D 29/054*** | (2006.01) |
| ***F04D 29/056*** | (2006.01) |
| ***F26B 9/06*** | (2006.01) |
| ***F26B 25/00*** | (2006.01) |
| ***F26B 25/02*** | (2006.01) |

(52) U.S. Cl.

CPC ..... *F26B 9/00* (2013.01); *F04D 19/002* (2013.01); *F04D 29/054* (2013.01); *F04D 29/056* (2013.01); *F26B 9/06* (2013.01); *F26B 25/00* (2013.01); *F26B 25/02* (2013.01); *F26B 2210/16* (2013.01)

(58) Field of Classification Search

CPC .... F04D 19/002; F04D 29/054; F04D 29/056; F26B 9/00

See application file for complete search history.

(56) References Cited

U.S. PATENT DOCUMENTS

| | | | | |
|---|---|---|---|---|
| 3,910,717 | A * | 10/1975 | Thome | F04D 29/668 384/368 |
| 4,020,995 | A * | 5/1977 | Purrer | A01F 29/14 241/101.2 |
| 5,011,631 | A * | 4/1991 | Hwang | B01F 3/04539 261/30 |
| 5,142,125 | A * | 8/1992 | Fioroli | H05B 6/6473 126/21 A |
| 5,526,583 | A * | 6/1996 | Hull | F26B 9/006 34/191 |
| 7,963,048 | B2 | 6/2011 | Pollard | |
| 2006/0191414 | A1 * | 8/2006 | Lange | G01N 30/12 96/101 |

* cited by examiner

*Primary Examiner* — Dominick L Plakkoottam
(74) *Attorney, Agent, or Firm* — Jeffrey S. Melcher; Manelli Selter PLLC

(57) ABSTRACT

Provided are a fan for use in a kiln and a method of using a fan in a kiln. The fan is connected to a motor using a hollow shaft and universal joints. An expansion joint is used to allow the hollow shaft to contract and expand during use. The bearings are sealed against corrosion caused by an environment within the kiln.

8 Claims, 4 Drawing Sheets

FAN FOR DRYING OF LUMBER

FIELD OF THE INVENTION

The invention relates to a fan suitable for use in a kiln and a method of using a fan in a kiln.

BACKGROUND OF THE INVENTION

Drying lumber was conventionally performed in a batch kiln process, where an insulated chamber is used that is adapted to control several drying process conditions, including, but not limited to air temperature in the kiln, air speed across the lumber, and the relative humidity in the chamber. As these kilns are a closed atmosphere, packages of sawn lumber, often referred to as green lumber, separated by stickers are placed in the kiln in batches. The packages are often loaded vertically, horizontally, and end to end.

Once the batch of packages are in place, the chamber is closed and a schedule or recipe of temperatures and relative humidity is initiated for a determined time interval or until a certain moisture content in the lumber is achieved. Generally, the schedule gradually increases the temperature in the chamber and lowers the relative humidity. This allows the lumber to release its moisture to the surrounding air, which may then be vented to the outside atmosphere.

The particular schedule used and the drying time varies depending on a number of factors, including, but not limited to, lumber type/species, thickness, moisture content, end use of the lumber and the like. Once the schedule has run, the kiln doors are opened and the packages are removed from the kiln chamber and further prepared for shipping to a final destination. This opens the chamber to atmospheric conditions and can often require a significant amount of time and energy to bring the next charge of green lumber up to drying conditions. In a batch drying process, as described above, ordinary maintenance could and would occur between batches.

Recently, kiln technology has introduced the Dual Path or continuous Kiln, U.S. Pat. No. 7,963,048 (Pollard), the complete disclosure of which is incorporated herein by reference. A dual path kiln is one that includes a continuous kiln having one or more chambers and at least two lumber charge paths adapted to convey lumber through the kiln in opposite directions. The lumber is pushed at a given rate of speed in a counter-flow process through the kiln in a continuous 24/7 process. Ordinary maintenance is difficult, if not impossible as it is very inefficient, time consuming and cost prohibitive to shut down this drying process.

One of the components of a kiln is a motorized fan(s) that is used to transfer the heat (either steam or direct fired) through the kiln. Depending on the size of the kiln, several fans are used. These fans are mounted on shafts and bearings, which are located inside the drying chamber, in direct contact with the heat and moisture. This atmosphere is very caustic and acidic and causes fan bearing failure problems prematurely, prior to scheduled maintenance times.

These fans are typically mounted on individual shafts with the shafts protruding through the kiln sidewall. These shafts can have two or more bearings located between the electric motor and fan assembly. Heat causes expansion problems in the drive shafts, which introduce unwanted stresses into the bearings, contributing to their failure. Alignment of these shafts and bearings is critical and changes with temperature, making it difficult to obtain long bearing life. Since the drive shaft is typically solid, natural frequency problems often occur, causing premature bearing failure. A conventional kiln fan is shown in FIG. 1 (prior art), having a solid shaft 6 connecting the fan blade 2 to the motor 10, and being held in place by bearings 4. The shaft 6 penetrates through the kiln wall 12.

SUMMARY OF THE INVENTION

An objective of the invention is to provide an improved fan suitable for use in a kiln.

The invention relates to a fan assembly suitable for use in a kiln comprising:

- a fan blade located within a kiln;
- at least one shaft connecting the fan blade to a motor, wherein the motor is located external to the kiln, and at least one shaft is hollow;
- an expansion joint constructed to allow the at least one shaft to contract and expand;
- at least one bearing assembly constructed to hold the at least one shaft in place, wherein the at least one bearing assembly being located within the kiln; and
- an external bearing housing protecting the at least one bearing assembly from an environment within the kiln.

The invention also relates to a method of operating a kiln comprising:

- driving a fan blade located inside a kiln by a motor located outside the kiln, wherein the motor is connected to the fan blade by at least one shaft, an expansion joint constructed to allow the at least one shaft to contract and expand, the at least shaft being held in place by at least one bearing assembly being located within the kiln, and an external bearing housing protecting the at least one bearing assembly from an environment within the kiln, and the at least one shaft is hollow.

DETAILED DESCRIPTION OF THE INVENTION

The invention will be explained with reference to the attached non-limiting drawings.

Figure 1:
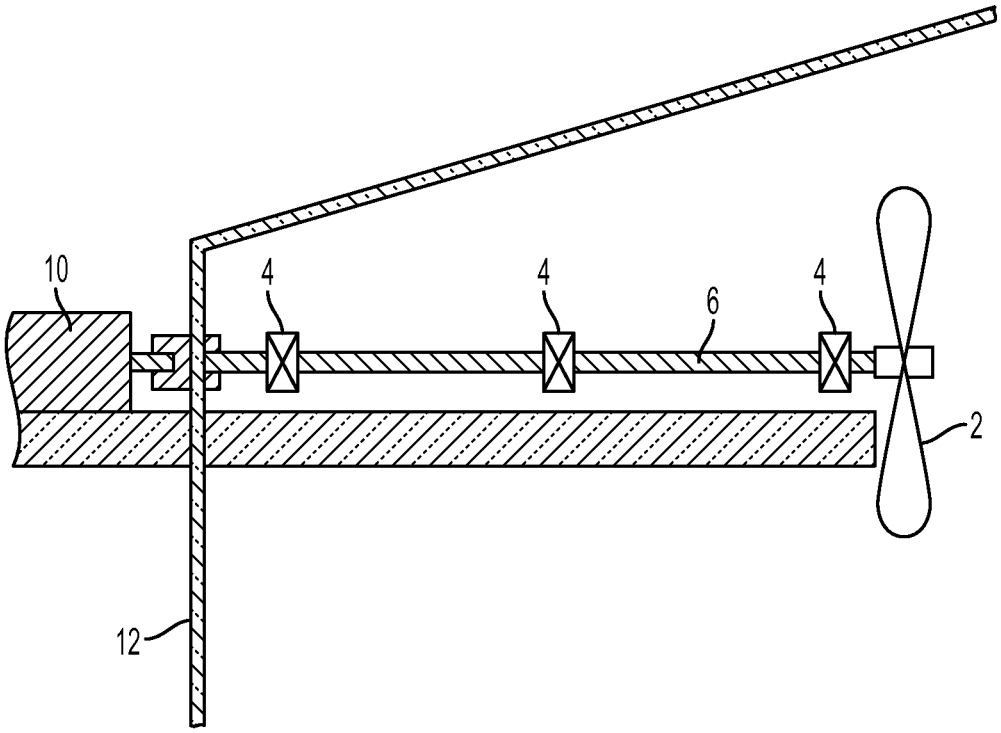
FIG. 1 PRIOR ART
FIG. 1 is a view of a conventional kiln fan.
Figure 2:
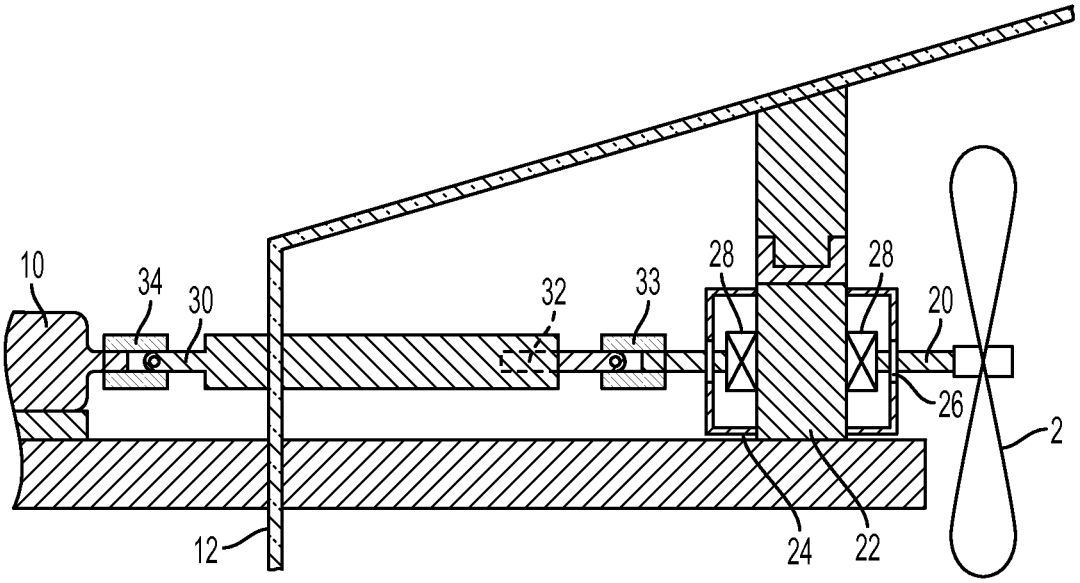
FIG. 2 is a view of a kiln fan according to the present invention.
Figure 3:
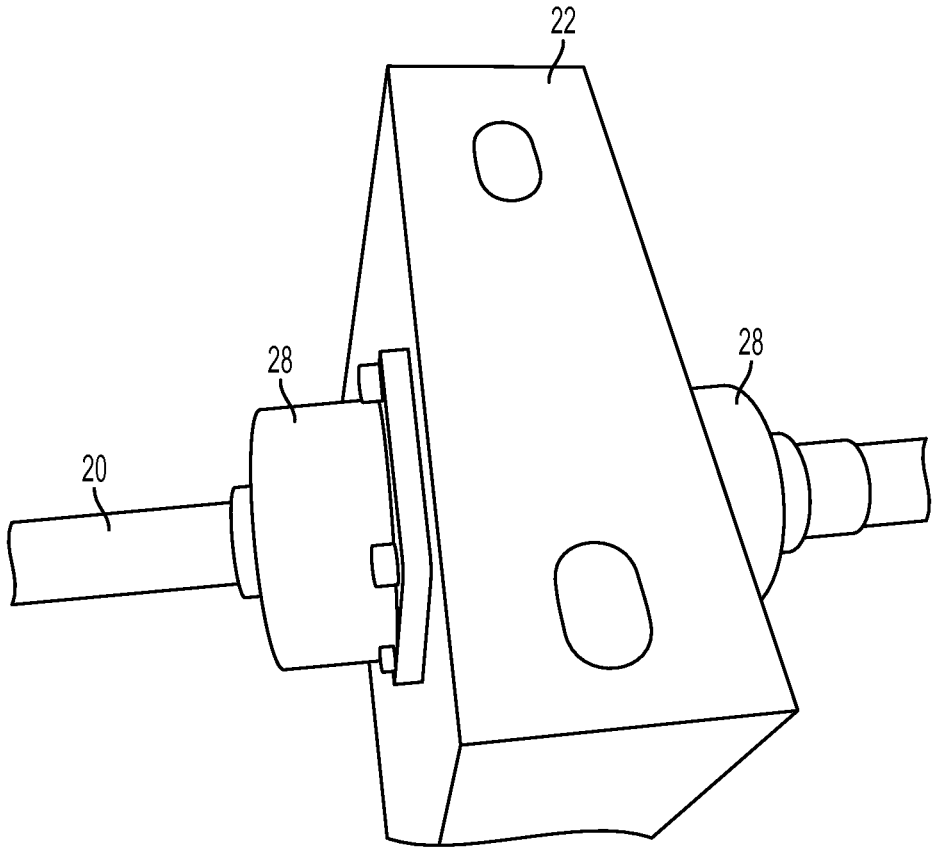
FIG. 3 is a view of a bearing housing.
Figure 4:
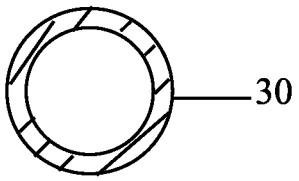
FIG. 4 is a view of a hollow shaft 30.
Figure 5:
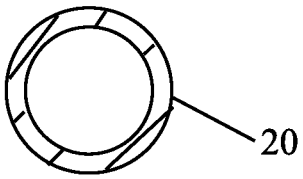
FIG. 5 is a view of hollow shaft 20.

FIGS. 2 and 3 show an improved fan assembly according to the present invention. The motor 10 is mounted outside of the kiln wall 12. The fan blade 2 is connected to a shaft 20. The shaft 20 is connected to a shaft 30 by a universal joint 33. The shaft 30 connects to the motor 10 by a universal joint 34. The shaft 30 passes through the kiln wall 12. The shaft 20 is held in place by bearings 28. The bearings 28 are mounted on a bearing housing 22 and are covered by external bearing housings 24. Seals 26, such as rubber or other suitable material, can seal the shaft 20 to the external bearing housings 24. The bearing housing 22 can be made from any suitable material, such as metal, composite, or plastic, with aluminum being preferred. The external bearing housings 24 can be formed of any suitable material, such as metal, composite and plastic. The bearings 28 are protected from the harsh environment in the kiln by the external bearing housings 24. The motor 10 can be any suitable motor, with an electric motor being preferred. At least one of the shafts 20 and 30 are hollow, which the shaft 30 preferably being hollow, as shown in FIGS. 4 and 5. An expansion joint 32 allows the shaft 30 to contract and expand in length during use. The shafts 20 and 30 can be formed of any suitable material, such as metal and composites, with metal being preferred.

Kilns for drying lumber are known and the present invention can be used in any kiln. The improved fan disclosed herein can be used in place of the conventional fans now being used in kilns. The controls for the conventional fans can be used to control the improved fan described herein. Preferably, the kiln is a continuous kiln.

The present invention provides the following advantages. No bearing alignment is necessary since the fan is driven with drive shaft connected to the motor by a universal joint. Problems with natural frequency are not an issue since the drive shaft is hollow and the revolutions per minute (rpm) of the motor is further away from the natural frequency rpm compared to a conventional solid shaft. Since the bearings are now sealed with external bearing housings, they are not subject to steam, corrosion, or other caustic atmospheric conditions that exist within the kiln chamber.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

The invention claimed is:

1. A fan assembly suitable for use in a kiln comprising:

a fan blade located within the kiln;

a motor external to the kiln;

a first shaft being hollow, a first portion of the first shaft being located outside the kiln and a second portion of the first shaft being located within the kiln;

a first universal joint connecting the motor to the first shaft;

a second shaft connected to the fan blade, the second shaft being solely located within the kiln;

a second universal joint connecting the second shaft to the first shaft;

an expansion joint constructed to allow the first shaft to contract and expand;

a bearing assembly constructed to hold the second shaft in place, wherein the at least one bearing assembly being located within the kiln; and an external bearing housing protecting the bearing assembly from an environment within the kiln.

2. The fan assembly according to claim 1, wherein the second shaft is hollow.

3. The fan assembly according to claim 1, wherein the bearing assembly comprises two bearings spaced apart and mounted in a bearing housing.

4. The fan assembly according to claim 1, wherein the kiln is a continuous kiln.

5. The fan assembly according to claim 1, wherein the first and second shafts are connected by the expansion joint and the second universal joint.

6. The fan assembly according to claim 1, wherein the motor is an electric motor.

7. A method of operating a kiln comprising the fan assembly according to claim 1 comprising:

driving the fan blade located inside the kiln by the motor located outside the kiln.

8. The method according to claim 7, wherein the kiln is a continuous kiln.

* * * * *